US006913113B2

(12) United States Patent
Shannon

(10) Patent No.: US 6,913,113 B2
(45) Date of Patent: Jul. 5, 2005

(54) ADJUSTABLE-HEIGHT LADDER

(76) Inventor: Kyle Shannon, Box 2351, Chetwynd, BC (CA), V0C 1J0

( * ) Notice: Subject to any disclaimer, the term of this patent is extended or adjusted under 35 U.S.C. 154(b) by 4 days.

(21) Appl. No.: 10/352,969

(22) Filed: Jan. 29, 2003

(65) Prior Publication Data

US 2003/0159881 A1 Aug. 28, 2003

(51) Int. Cl.[7] ..... E06C 1/00
(52) U.S. Cl. ..... 182/22; 182/165; 182/207
(58) Field of Search ..... 182/165–167, 182/22, 23, 24, 25, 26, 207, 209, 210, 211

(56) References Cited

U.S. PATENT DOCUMENTS

| | | | | | |
|---|---|---|---|---|---|
| 287,793 | A | * | 11/1883 | Bell | 182/167 |
| 534,463 | A | | 2/1895 | Bowser | |
| 548,670 | A | * | 10/1895 | Stephenson | 182/167 |
| 737,636 | A | * | 9/1903 | Latta | 182/167 |
| 1,274,683 | A | * | 8/1918 | Champion | 182/166 |
| 1,670,653 | A | | 5/1928 | Cummings | |
| 1,935,349 | A | * | 11/1933 | Breslow | 182/22 |
| 2,261,479 | A | | 11/1941 | Moen | |
| 3,196,981 | A | | 7/1965 | Winnall | |
| 3,474,883 | A | | 10/1969 | Weis | |
| 5,000,289 | A | * | 3/1991 | Sanchez, III | 182/167 |
| 5,577,574 | A | | 11/1996 | Joseph | |
| 5,853,065 | A | | 12/1998 | Hutson et al. | |
| 5,971,102 | A | | 10/1999 | Brown | |

* cited by examiner

*Primary Examiner*—Alvin Chin-Shue
(74) *Attorney, Agent, or Firm*—Donald V. Tomkins

(57) ABSTRACT

An adjustable-height stepladder has an upper-front frame and an upper-rear frame interconnected by a top member. The upper-front frame and the upper-rear frame each have an elongate slide track. A lower-front frame, wider than the upper-front frame and positioned centrally rearward thereof, has a pair of rails, each having a slide mechanism slidingly engageable with the slide track of the corresponding upper-front frame rail. A lower-rear frame, wider than the upper-rear frame and positioned centrally forward thereof, has a pair of rails, each having a slide mechanism slidingly engageable with the slide track of the corresponding upper-rear frame rail. Each slide mechanism has a hinged swing arm and a biasing spring, the combination of which allows the slide mechanisms to engage the slide tracks although the lateral distance between the upper-frame rails and their corresponding lower-frame rails may vary. Accordingly, the stepladder is height-adjustable when the rails of the various frames are flared as well as when they are parallel.

9 Claims, 6 Drawing Sheets

ADJUSTABLE-HEIGHT LADDER

FIELD OF THE INVENTION

The present invention relates to adjustable-height ladders, and to adjustable-height stepladders in particular.

BACKGROUND OF THE INVENTION

Ladders have long been used throughout the world for a variety of purposes. Fixed, single-section ladders may be conveniently used where the top of the ladder can be stabilized against a wall or other structure. Where no stabilizing structure is conveniently available, it is often desirable to use a stepladder having a ladder section and a prop section, the tops of these sections being hinged together so that they can be spread apart to form an inherently stable stepladder.

The desirable height of a ladder or stepladder depends on how high the object or space sought to be accessed is above the ground or working surface. For example, a 6-foot high ladder or stepladder may be satisfactory for gaining access as high as 10 feet or so above ground, but a considerably taller ladder would be needed if access must be had 20 feet above ground. However, such a taller ladder will not necessarily be suitable for convenient access to locations closer to the ground. If a particular project requires access to locations at a variety of heights, one option is to have available two or more ladders or stepladders of varying heights. This is not a preferred option, as it entails the extra expense of multiple ladders, the need to transport multiple ladders to and from the project site, and the need for an increased amount of space to store the ladders when they are not being used.

To address these problems, a number of adjustable ladders and stepladders have been developed over the years. There are numerous examples of extension ladders in the prior art, typically featuring an upper ladder section overlapping a lower ladder section. The two sections may slide relative to each other to create a ladder of a desired height, up to nearly double the height of a single section. By providing utility over a larger range of heights, and being collapsible for compact storage, extension ladders of this type have enjoyed widespread acceptance as a solution to the noted problems.

However, the mechanisms of conventional extension ladders typically work only for ladders having parallel rails. It is well known that a given structure, having a given top width, will have greater lateral stability if its base width is greater than at its top width, as compared to the case where the width is constant. This principle has often been applied to fixed ladders, especially tall ladders; i.e., it is well known to construct fixed ladders with flared rails, in order to enhance the ladders' lateral stability and therefore the safety of persons using the ladders. However, attempts to create an extension ladder having flared rails have not been successful.

The prior art discloses numerous examples of adjustable stepladders. U.S. Pat. No. 534,463, issued Feb. 19, 1895 to Bowser, U.S. Pat. No. 1,670,653, issued May 22, 1928 to Cummins, and U.S. Pat. No. 5,000,289, issued Mar. 19, 1991 to Sanchez, all disclose a stepladder featuring an upper ladder section and a slidable lower ladder section, plus an upper prop section and a slidable lower prop section. A disadvantage common to all of these inventions is that each requires one or both of the ladder sections to have parallel rails; i.e., they will not work where both the upper ladder section and the lower ladder section have the desirable feature of flared rails. Furthermore, in each of these inventions, the width of the upper ladder section must be controlled within close tolerances to suit the configuration of the lower ladder section.

For the foregoing reasons, there is a need for a stepladder which is conveniently adjustable in height when the rails of the ladder sections are flared as well as when they are parallel, and wherein the ladder section can be adjusted independently of the prop section. In addition, there is a need for an extension ladder which is conveniently adjustable in height when the rails of the ladder sections are flared, as well as when they are parallel. The present invention is directed to these needs.

BRIEF SUMMARY OF THE INVENTION

In general terms, the present invention is an adjustable stepladder, each section of which has either flared rails (i.e., the rails being farther apart at the bottom that at the top) or parallel rails. The height of the stepladder can be adjusted, even in embodiments having flared rails, by means of a slide mechanism which permits upper and lower ladder sections to be moved longitudinally relative to each other, while adjusting itself to accommodate the variable width between the rails, and at the same time keeping all sections of the stepladder substantially aligned on a common centerline.

Accordingly, in one aspect, the present invention is an adjustable stepladder comprising:

(a) an upper-front frame having:

two elongate upper-front rails, each having an elongate front slide track running substantially parallel thereto, and each having a top end and a bottom end; and a plurality of upper steps spanning between the upper-front rails;

(b) a lower-front frame positioned rearward of the upper-front frame and having:

two elongate lower-front rails, each having a front slide mechanism slidingly engageable with the front slide track of a corresponding upper-front rail, and each having a top end and a bottom end; and a plurality of lower steps spanning between the lower-front rails;

(c) front locking means, for disengageably locking the lower-front frame in a desired position relative to the upper-front frame;

(d) an upper-rear frame having:

two elongate upper-rear rails, each having an elongate rear slide track running substantially parallel thereto, and each having a top end and a bottom end; and one or more upper struts spanning between the upper-rear rails;

(e) a lower-rear frame positioned forward of the upper-rear frame and having:

two elongate lower-rear rails, each having a rear slide mechanism slidingly engageable with the rear slide track of a corresponding upper-rear rail, and each having a top end and a bottom end; and one or more lower struts spanning between the lower-rear rails;

(f) rear locking means, for disengageably locking the lower-rear frame in a desired position relative to the upper-rear frame; and (g) a top member interconnecting the top ends of the of the upper-front rails and the top ends of the upper-rear rails; wherein:

(h) the upper-front frame, the lower-front frame, the upper-rear frame, and the lower-rear frame are substantially symmetrical about a common centerline;

(i) the lower-front frame may be selectively positioned relative to the upper-front frame by moving the front slide mechanisms within their corresponding front slide tracks;

(j) the lower-rear frame may be selectively positioned relative to the upper-rear frame by moving the rear slide mechanisms within their corresponding rear slide tracks;

(k) in all configurations of the stepladder, and as measured in any plane perpendicular to said centerline and intersecting both the upper-front frame and the lower-front frame, the upper-front frame is narrower than the lower-front frame; and (l) in all configurations of the stepladder, and as measured in any plane perpendicular to said centerline and intersecting both the upper-rear frame and the lower-rear frame, the upper-rear frame is narrower than the lower-rear frame.

In the preferred embodiment, each front slide mechanism comprises:

(a) a front swing arm hingingly connected to the corresponding lower-front rail;

(b) front spring means for biasing the front swing arm to swing away from said lower-front rail; and (c) a front slide member swivellably and rotatably connected to the front swing arm, said front slide member being slidingly engageable with the front slide track of the corresponding upper-front rail;

and wherein each rear slide mechanism comprises:

(d) a rear swing arm hingingly connected to the corresponding lower-rear rail;

(e) rear spring means for biasing the rear swing arm to swing away from said lower-rear rail; and (f) a rear slide member swivellably and rotatably connected to the rear swing arm, said rear slide member being slidingly engageable with the rear slide track of the corresponding upper-rear rail.

In another aspect, the invention is an extension ladder comprising:

(a) an upper frame having:

two elongate upper rails, each having an elongate slide track running substantially parallel thereto, and each having a top end and a bottom end; and a plurality of upper steps spanning between the upper rails;

(b) a lower frame positioned rearward of the upper frame, said lower frame being wider than the upper frame and having:

two elongate lower rails, each having a slide mechanism slidingly engageable with the slide track of a corresponding upper rail, and each having a top end and a bottom end; and a plurality of lower steps spanning between the lower rails; and (c) locking means, for disengageably locking the lower frame in a desired position relative to the upper frame;

wherein:

(d) the upper frame and the lower frame are substantially symmetrical about a common centerline;

(e) the lower frame may be selectively positioned relative to the upper frame by moving the slide mechanisms within their corresponding slide tracks; and (f) in all configurations of the extension ladder, and as measured in any plane perpendicular to said centerline and intersecting both the upper frame and the lower frame, the upper frame is narrower than the lower frame.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
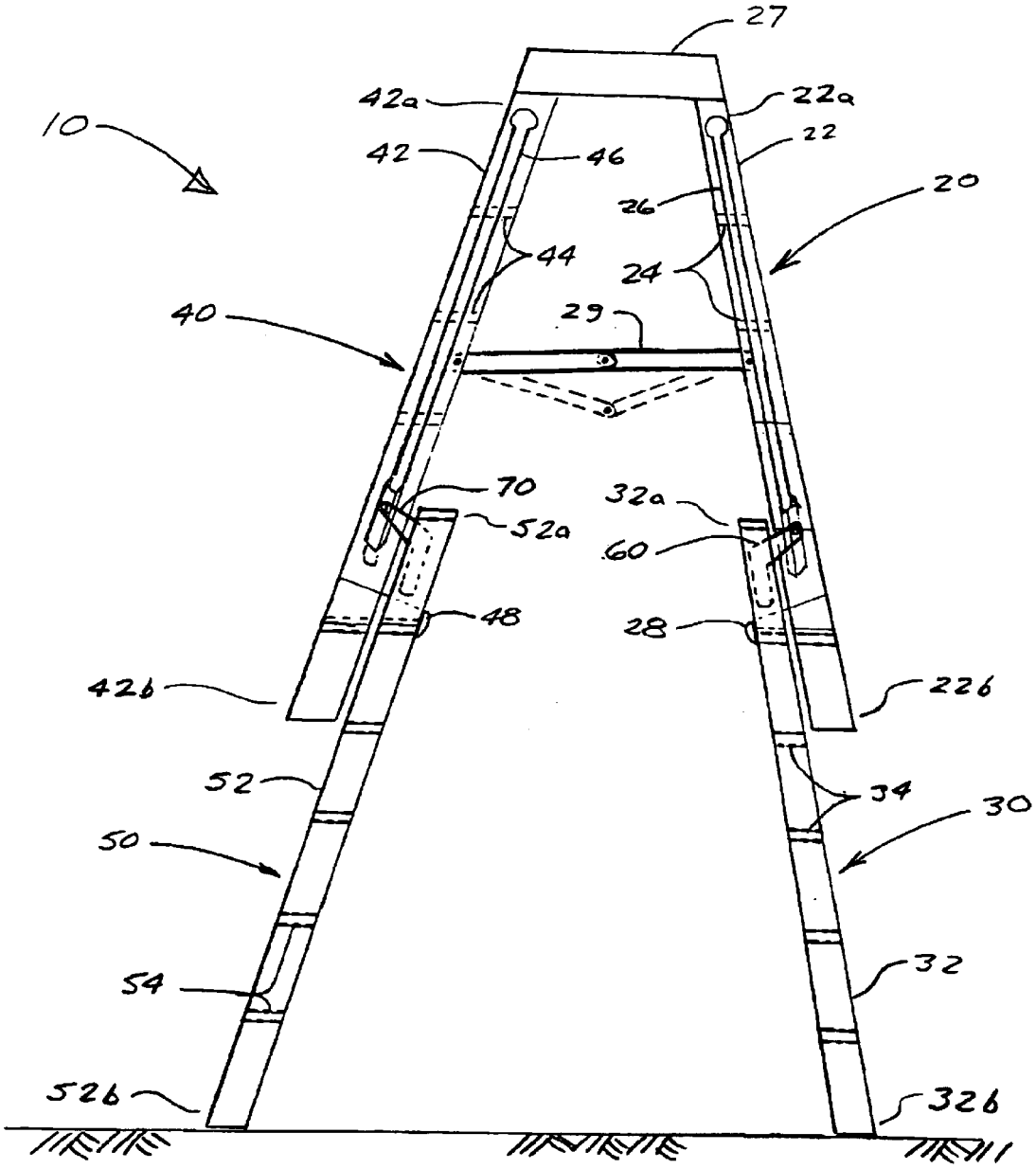
FIG. 1 is an side elevational view of the preferred embodiment of an adjustable stepladder in accordance with the invention.
Figure 2A:
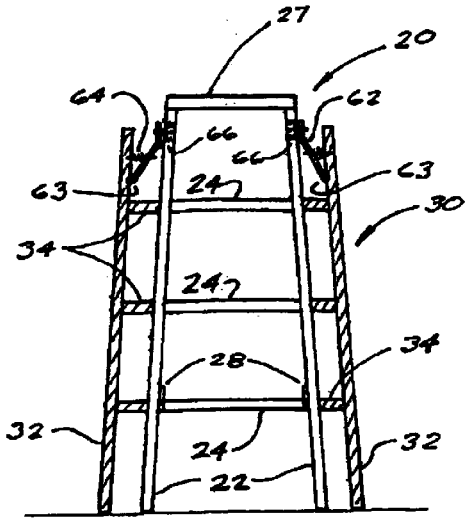
FIG. 2A is a front elevation of an embodiment of an adjustable stepladder in accordance with the invention in which each section of the stepladder has flared rails, shown in a lowered configuration.
Figure 2B:
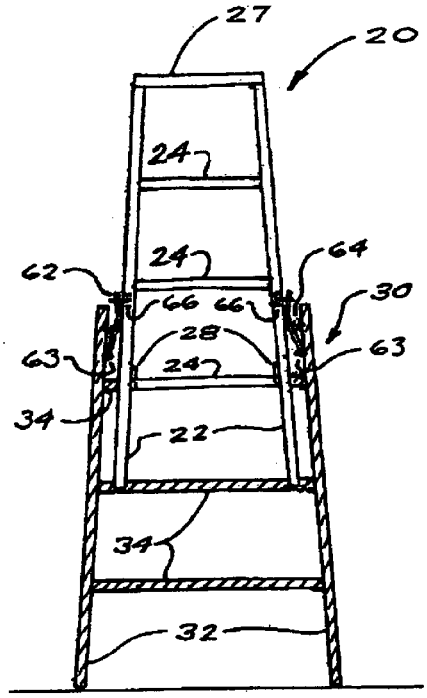
FIG. 2B is a front elevation of the adjustable stepladder illustrated in FIG. 2A, shown in a raised configuration.

As illustrated in FIGS. 1, 2A, and 2B, the adjustable stepladder of the present invention, generally represented by reference numeral (10), has an upper-front frame (20), a lower-front frame (30), an upper-rear frame (40), and a lower-rear frame (50). The upper-front frame (20) includes a pair of elongate upper-front rails (22) lying substantially in a common plane, and the upper-front rails (22) are spaced apart by a plurality of upper steps (24) spanning therebetween. Each upper-front rail (22) has a top end **(22*a*) and a bottom end (22*b*). Connected to and running substantially parallel to each upper-front rail (22) is an elongate front slide track (26). In the preferred embodiment, the upper-front frame (20), when viewed from the front, will be wider at the bottom than at the top, as shown in FIG. 2A and FIG. 2**B. This configuration provides enhanced lateral stability compared to a frame having a lower width equal to its top width. However, the upper-front frame may be of constant width (i.e., having parallel upper-front rails) without departing from the fundamental concept of the invention.

The lower-front frame (30) includes a pair of elongate lower-front rails (32) plus a plurality of lower steps (34) spanning therebetween. Each lower-front rail (32) has a top end **(32*a*) and a bottom end (32*b*). When the stepladder (10) is assembled, the lower-front frame (30) is positioned rearward of the upper-front frame (20) and shares therewith a common centerline (as viewed from the front or the rear of the stepladder). In the preferred embodiment, the lower-front frame (30) will be wider at the top than at the bottom, as viewed from the front, as shown in FIG. 2A and FIG. 2**B, but may be of constant width if desired.

Figure 3A:
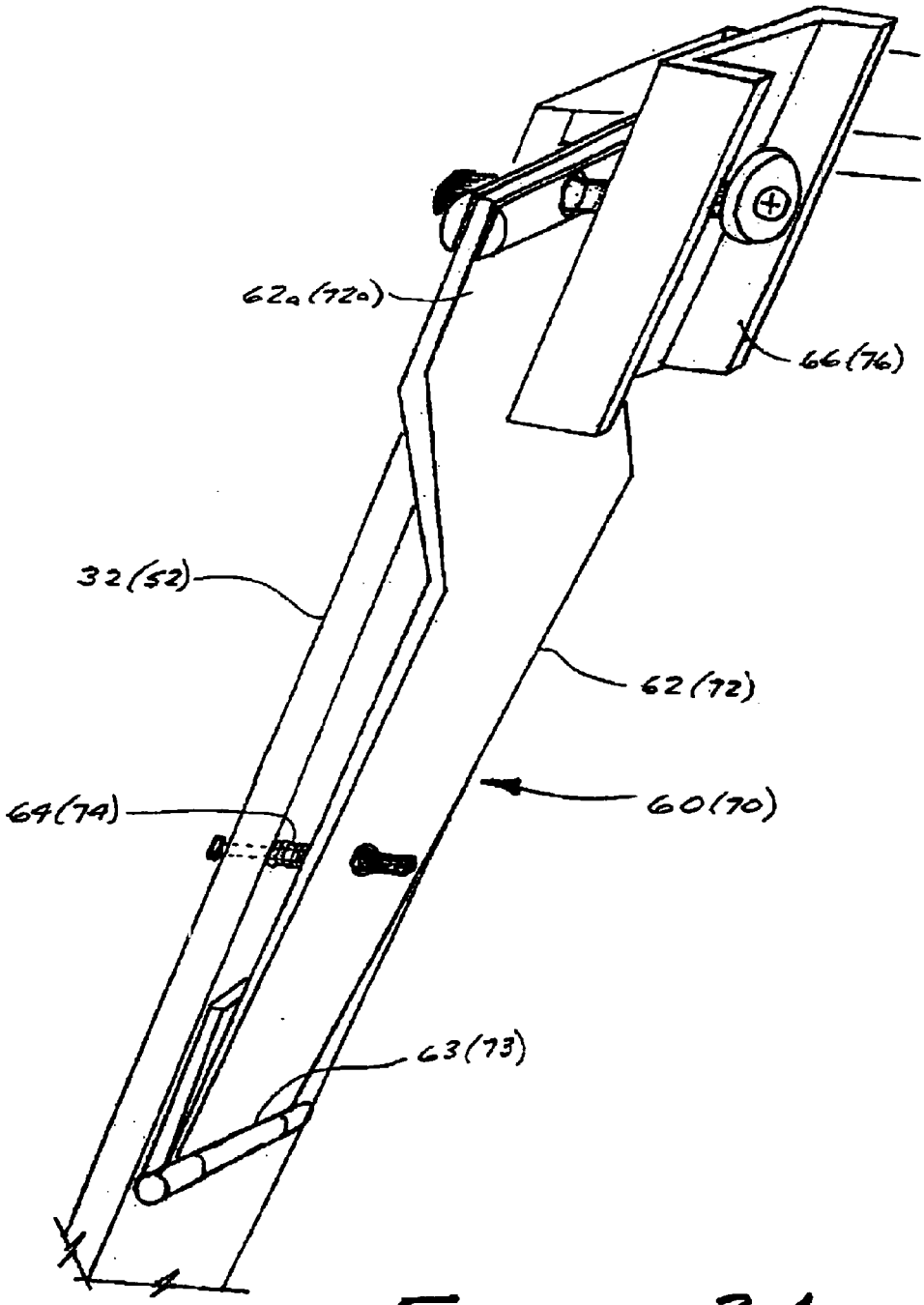
FIG. 3A is a perspective view of the slide mechanism of the preferred embodiment of the invention in which the slide member comprises a channel section.

Attached to each lower-front rail (32) near the top thereof is a front slide mechanism (60) which is engageable with the front slide track (26) of the corresponding upper-front rail (22). Referring to FIG. 3A, the front slide mechanism (60) in the preferred embodiment includes a front swing arm (62) hingingly mounted on the inner face of the lower-front rail (32) so that the front swing arm (62) can pivot inwardly from the lower-front rail (32); i.e., toward the centerline. A spring means (64) disposed between the front swing arm (62) and the lower-front rail (32) biases the front swing arm (62) to swing inwardly from the lower-front rail (32). The front swing arm (62) is configured such that its free end (62*a*) may be aligned with the front slide track (26) of the corresponding upper-front rail (22). A front slide member (66) is attached to the free end (62*a*) of the front swing arm (62) in such fashion that it is free to swivel and rotate in all directions relative to the front swing arm (62).

Figure 3B:
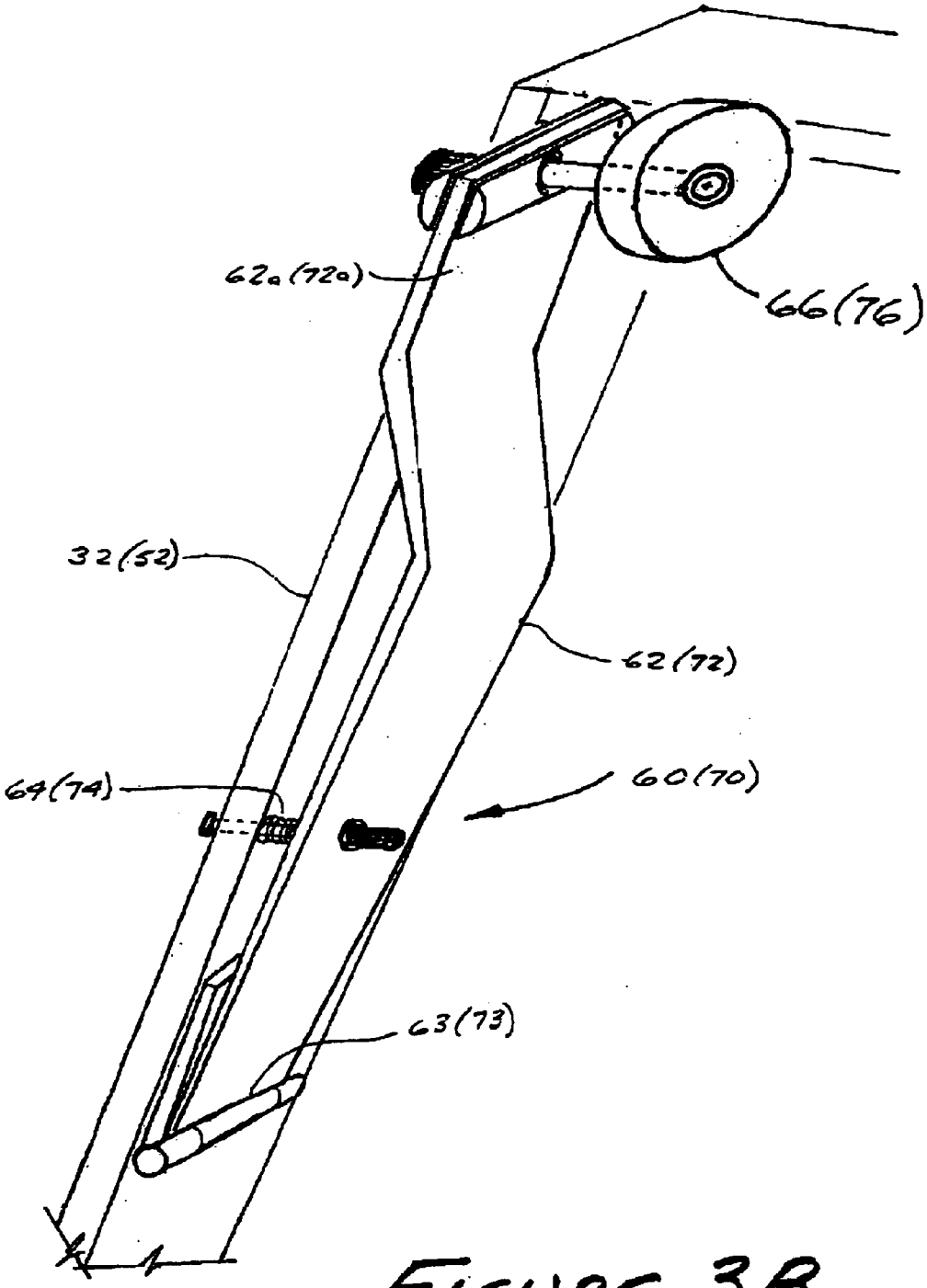
FIG. 3B is a perspective view of an alternative embodiment of the slide mechanism in which the slide member comprises a wheel.
Figure 3C:
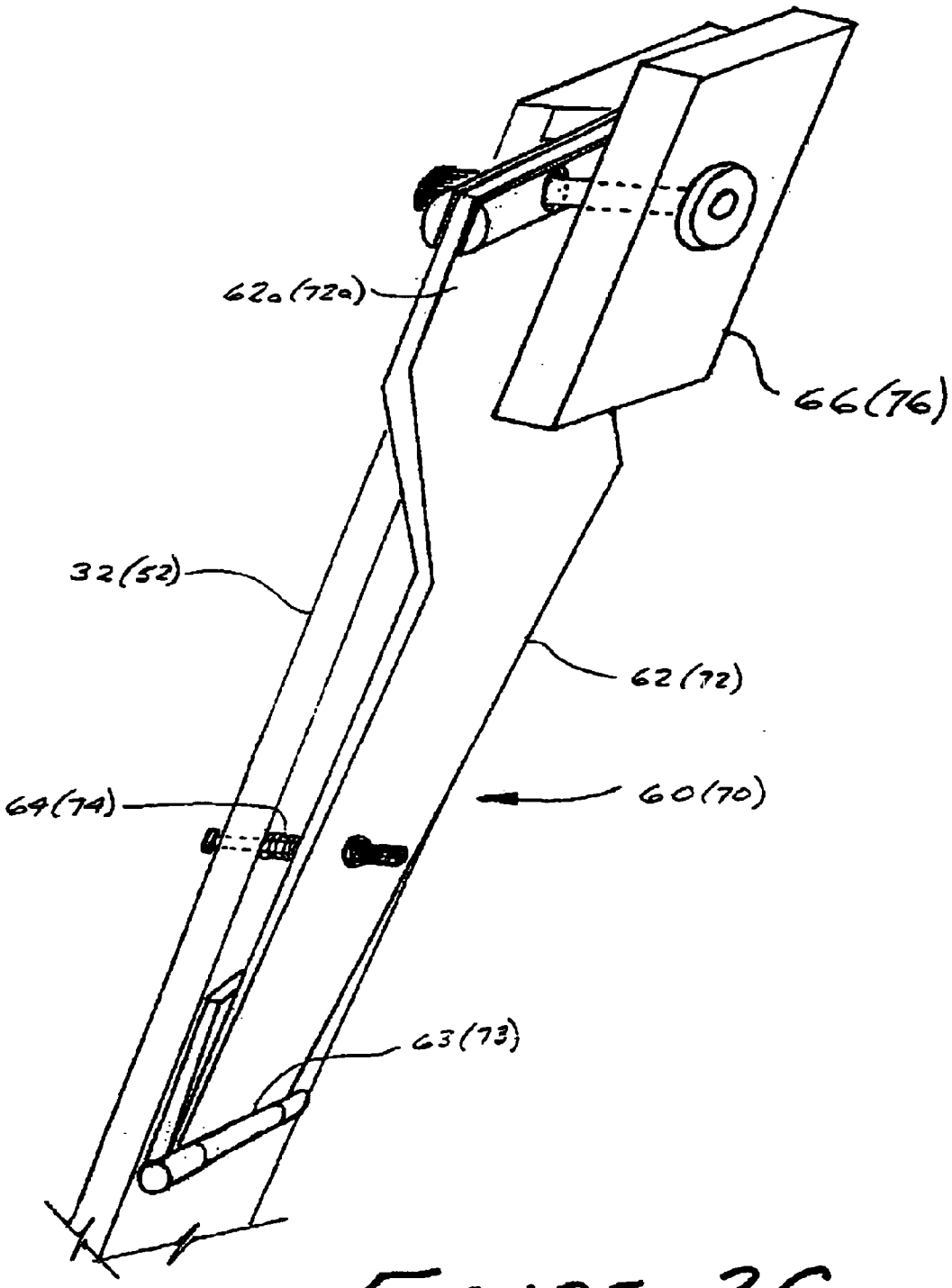
FIG. 3C is a detail of a further alternative embodiment of the slide mechanism in which the slide member includes a flat plate.

As shown in FIG. 3A, the front slide member (66) may be provided in the form of a channel section. Alternatively, the rear slide member (66) may comprise a wheel as shown In FIG. 3B, or a flat plate as shown in FIG. 3C.

When the stepladder (10) is assembled, each front slide member (66) is positioned in the corresponding front slide track (26) so that it may slide therein. Because the front slide members (66) are free to swivel and rotate, the lower-front frame (30) may articulate relative to the upper-front frame (20) without impeding the ability of the front slide members (66) to slide within the front slide tracks (26). In the preferred embodiment, the front slide tracks (26) are configured such that the front slide members (66) may be conveniently disengaged therefrom, thereby entirely disengaging the lower-front frame (30) from the upper-front frame (20).

The upper-rear frame (40) includes a pair of elongate upper-rear rails (42) lying substantially in a common plane, and the upper-rear rails (42) are spaced apart by one or more upper struts (44) spanning therebetween. Each upper-rear rail (42) has a top end (42*a*) and a bottom end (42*b*). Connected to and running substantially parallel to each upper-rear rail (42) is a rear slide track (46). In the preferred embodiment, the upper-rear frame (40), when viewed from the rear, will be wider at the bottom than at the top, but may be of constant width if desired.

The lower-rear frame (50) includes a pair of elongate lower-rear rails (52) plus a plurality of lower struts (54) spanning therebetween. Each lower-rear rail (52) has a top end (52*a*) and a bottom end (52*b*). When the stepladder (10) is assembled and viewed from the rear, the lower-rear frame (50) is positioned forward of the upper-rear frame (40) and shares therewith a common centerline. In the preferred embodiment, the lower-rear frame (50) will be wider at the top than at the bottom, but may be of constant width if desired.

Attached to each lower-rear rail (52) near the top thereof is a rear slide mechanism (70) which is engageable with the rear slide track (46) of the corresponding upper-rear rail (42). Referring to FIG. 3A, the rear slide mechanism (70) in the preferred embodiment includes a rear swing arm (72) hingingly mounted on the inner face of the lower-rear rail (52) so that the rear swing arm (72) can pivot inwardly from the lower-rear rail (52); i.e., toward the centerline. A spring means (74) disposed between the rear swing arm (72) and the lower-rear rail (52) biases the rear swing arm (72) to swing inwardly from the lower-rear rail (52). The rear swing arm (72) is configured such that its free end (72*a*) may be aligned with the rear slide track (46) of the corresponding upper-rear rail (42). A rear slide member (76) is attached to the free end (72*a*) of the rear swing arm (72) in such fashion that it is free to swivel and rotate in all directions relative to the rear swing arm (72).

As shown in FIG. 3A, the rear slide member (76) may be provided in the form of a channel section. Alternatively, the rear slide member (76) may comprise a wheel as shown In FIG. 3B, or a flat plate as shown in FIG. 3C.

When the stepladder (10) is assembled, each rear slide member (76) is positioned in the corresponding rear slide track (46) so that it may slide therein. Because the rear slide members (76) are free to swivel and rotate, the lower-rear frame (50) may articulate relative to the upper-rear frame (40) without impeding the ability of the rear slide members (76) to slide within the rear slide tracks (46). In the preferred embodiment, the rear slide tracks (46) are configured such that the rear slide members (76) may be conveniently disengaged therefrom, thereby entirely disengaging the lower-rear frame (50) from the upper-rear frame (40).

Referring again to FIG. 1, the stepladder (10) also features a top member (27) spanning across the upper ends of the upper-front frame (20) and the upper-rear frame (40). In order to enhance the stability of the stepladder (10) when in use, the top member (27) is rigidly connected to either the upper-front frame (20) or the upper-rear frame (40), or to both. In the preferred embodiment, the top member (27) is rigidly connected to the upper-front frame (20) only, and is hingingly connected to the upper-rear frame (40), thereby facilitating folding and compact storage of the stepladder (10). Alternatively, the top member (27) may be rigidly connected to the upper-rear frame (40) only, and hingingly connected to the upper-front frame (20), to achieve essentially the same foldability.

Also in the preferred embodiment, bracing means is provided to hold the assembly of the upper-front frame (20) and the lower-front frame (30) in a substantially fixed relationship relative to the assembly of the upper-rear frame (40) and the lower-rear frame (50). As illustrated in FIG. 1, the bracing means may be conveniently provided in the form of a hinged brace (29) of a type well known in the art of stepladders, with the hinged brace (29) being pivotally connected to the upper-front frame (20) at one end and to the upper-rear frame (40) at the other end. It will be readily appreciated that the hinged brace (29) must be detachable from either or both of the upper-front frame (20) and the upper-rear frame (40), in order to permit full-range movement of the lower-front frame (30) and the lower-rear frame (50) relative to the upper-front frame (20) and the upper-rear frame (40) respectively.

To further enhance the stability of the stepladder (10) when in use, the upper-front frame (20) has front locking means (28), disengageably lockable to a selected lower step, and the upper-rear frame (40) has rear locking means (48) disengageably lockable to a selected lower rail. In the preferred embodiment, the front locking means (28) will include a pair of brackets, one rigidly connected to and projecting rearwardly from each of the upper-front rails (22) near the lower end thereof, as illustrated in FIG. 1. Similarly, the rear locking means (48), will include a pair of brackets, one rigidly connected to and projecting frontwardly from each of the upper-rear rails (42) near the lower end thereof. When the lower-front frame (30) has been positioned as desired relative to the upper-front frame (20), by sliding the front slides (66) within the front slide tracks (26) and pivoting the lower-front frame (30) relative to the upper-front frame (20) as appropriate, the brackets of the front locking means (28) may be positioned to engage one of the lower steps (34) so as to prevent the lower-front frame (30) from sliding or articulating relative to the upper-front frame (20). Similarly, when the lower-rear frame (50) has been positioned as desired relative to the upper-rear frame (40), by sliding the rear slides (76) within the rear slide tracks (46) and pivoting the lower-rear frame (30) relative to the upper-front frame (20) as appropriate, the brackets of the rear locking means (48) may be positioned to engage one of the lower struts (54) so as to prevent the lower-rear frame (50) from sliding or articulating relative to the upper-rear frame (40).

As may be seen from FIG. 2A and FIG. 2B, the stepladder (10) of the present invention may be conveniently adjusted in height by sliding the lower-front frame (30) to a desired position relative to the upper-front frame (20), sliding the lower-rear frame (50) to a desired position relative to the upper-rear frame (40), and then engaging the front locking means (28) and the rear locking means (48) as previously described. This procedure may entail pivoting lower-front frame (30) relative to the upper-front frame (20) and pivoting the lower-rear frame (50) relative to the upper-rear frame (40), to avoid interference of the front locking means (28) with the steps and interference of the rear locking means (48) with the struts as the lower-front frame (30) and the lower-rear frame (50) are moved to their desired positions.

As can be readily seen from FIG. 2A and FIG. 2B, in all configurations of the stepladder, and at any location where the upper-front frame is overlapping the lower-front frame, the upper-front frame is narrower than the lower-front frame, as measured in a plane perpendicular to the common centerline. Similarly, at any location where the upper-rear frame is overlapping the lower-rear frame, the upper-rear frame is narrower than the lower-rear frame, as measured in a plane perpendicular to the centerline. By virtue of this configuration, the front slide mechanisms (60) are always outboard of the front slide tracks (26) such that each front slide member (66) may engage its corresponding front slide track (26). Because the front swing arms (62) are hinged and the front slide members (66) are swivellably and rotatably connected to their respective front swing arms (62), the front slide members (66) remain engageable with the front slide tracks (26) even though the lateral distance between a given lower-front rail (32) and its corresponding upper-front rail (22) may vary depending on the relative positions of the upper-front frame (20) and the lower-front frame (30). Similarly, because the rear swing arms (72) are hinged and the rear slide members (76) are swivellably and rotatably connected to their respective rear swing arms (72), the rear slide members (76) remain engageable with the rear slide tracks (46) even though the lateral distance between a given lower-rear rail (52) and its corresponding upper-rear rail (42) may vary depending on the relative positions of the upper-rear frame (40) and the lower-rear frame (50).

Accordingly, the stepladder (10) of the present invention is fully adjustable not only when the upper-front frame (20), the lower-front frame (30), the upper-rear frame (40), and the lower-rear frame (50) are each of constant width, but also when each is wider at the bottom than at the top. The front spring means (64) cooperate with the front swing arms (62) such that the centerline of the upper-front frame (20) remains substantially coincident with the centerline of the lower-front frame (30) regardless of their relative positions. Similarly, the rear spring means (74) cooperate with the rear swing arms (72) such that the centerline of the upper-rear frame (40) remains substantially coincident with the centerline of the lower-rear frame (50) regardless of their relative positions.

It will also be readily seen that the stepladder (10) may be adjusted for use on uneven surfaces by differential positioning of the lower-front frame (30) and the lower-rear frame (50). It may further be seen that, in the preferred embodiment of the invention, the lower-front frame (30) and the lower-rear frame (50) may be disengaged completely from the upper-front frame (20) and the upper-rear frame (40) such that the assembly of the upper-front frame (20), the top member (27), and the upper-rear-frame (40) may be employed as a conventional non-adjustable stepladder.

Figure 4:
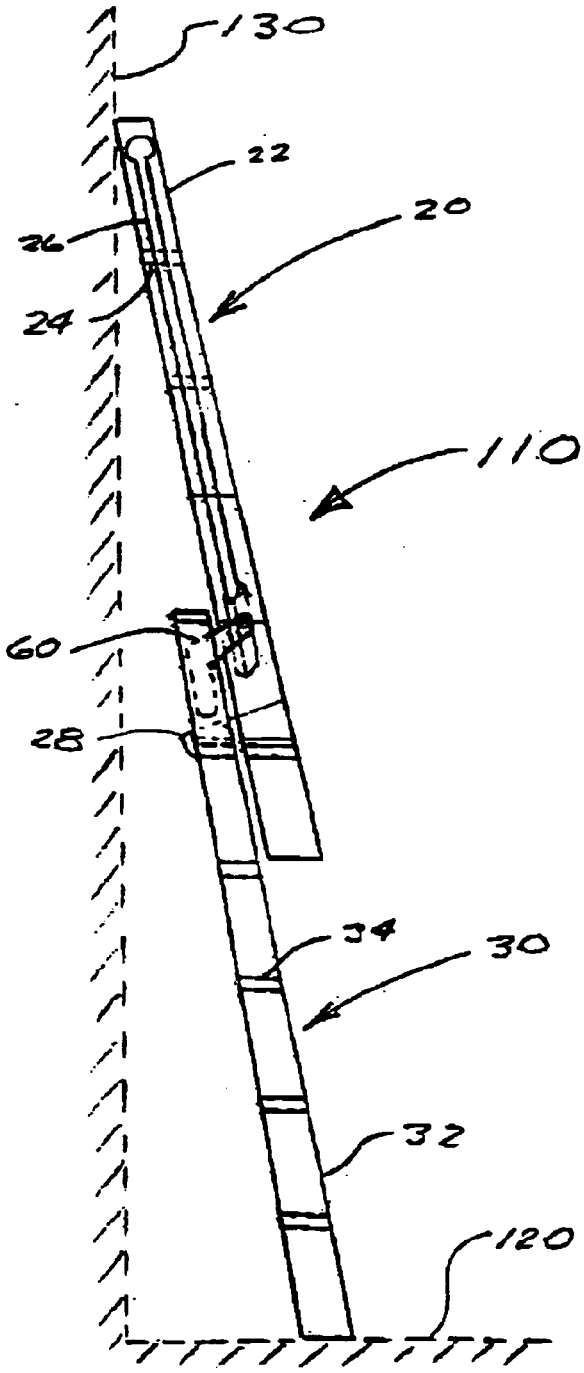
FIG. 4 is a side elevational view of the preferred embodiment of an extension ladder in accordance with the invention.

In a further embodiment, as illustrated in FIG. 4, the invention is an extension ladder (110) comprising an upper-front frame (20) and a lower-front frame (30) and all associated components as herein previously described in connection with the adjustable stepladder embodiment of the invention (10). When assembled in accordance with the preceding description, the upper-front frame (20) and the lower-front frame (30) form the extension ladder (110), which may be deployed as shown in FIG. 4; i.e., resting on a supporting surface (120) and leaning against a stabilizing surface (130). Like the stepladder (10), the extension ladder (110) is fully adjustable not only when the upper-front frame (20) and the lower-front frame (30) are each of constant width, but also when each is wider at the bottom than at the top. In the preferred embodiment, the upper-front frame (20) and the lower-front frame (30) may be disengaged from each other entirely, allowing either to be used independently as a fixed ladder.

In a yet further embodiment, the invention is a convertible adjustable stepladder comprising all of the components herein previously described in connection with the adjustable stepladder embodiment of the invention (10), with the additional feature that the upper-front rails (22) may be detached from the top member (27), thereby detaching the upper-front frame (20) and the lower-front frame (30) and associated slide mechanisms completely from the remainder of the assembly. The upper-front frame (20) and the lower-front frame (30) may then be used as an extension ladder, and subsequently reattached to the top member (27) for further use as an adjustable stepladder.

The foregoing is a description of a preferred embodiment of the invention which is given here by way of example only, and the invention is not to be taken as limited to any of the specific features described. It will be readily seen by those skilled in the art that various modifications of the invention may be devised without departing from the essential concept of the invention, and all such modifications are intended to be included in the scope of the claims appended hereto.

The embodiments of the invention in which an exclusive property or privilege is claimed are defined as follows:

1. An adjustable stepladder comprising:

(a) an upper-front frame having two elongate upper-front rails, each having an elongate front slide track running substantially parallel thereto, and each having a top end and a bottom end; and a plurality of upper steps spanning between the upper-front rails;

(b) a lower-front frame positioned rearward of the upper-front frame and having two elongate lower-front rails, each lower-front rail having a front slide mechanism slidingly engageable with the front slide track of a corresponding upper-front rail, each front slide mechanism comprising:

b.1 a front swing arm hingingly connected to the corresponding lower-front rail;

b.2 front spring means for biasing the front swing arm to swing away from said lower-front rail; and b.3 a front slide member swivellably and rotatably connected to the front swing arm, said front slide member being slidingly engageable with the front slide track of the corresponding upper-front rail:

and each lower-front rail having a top end and a bottom end; and a plurality of lower steps spanning between the lower-front rails;

(c) front locking means, for disengageably locking the lower-front frame in a desired position relative to the upper-front frame;

(d) an upper-rear frame having two elongate upper-rear rails, each having an elongate rear slide track running substantially parallel thereto, and each having a top end and a bottom end; and one or more upper struts spanning between the upper-rear rails;

(e) a lower-rear frame positioned forward of the upper-rear frame and having two elongate lower-rear rails, each lower-rear rail having a rear slide mechanism slidingly engageable with the rear slide track of a corresponding upper-rear rail, each rear slide mechanism comprising:

e.1 a rear swing arm hingingly connected to the corresponding lower-rear rail;

e.2 rear spring means for biasing the rear swing arm to swing away from said lower-rear rail; and e.3 a rear slide member swivellably and rotatably connected to the rear swing arm, said rear slide member being slidingly engageable with the rear slide track of the corresponding upper-rear rail;

and each lower-rear rail having a top end and a bottom end; and one or more lower struts spanning between the lower-rear rails;

(f) rear locking means, for disengageably locking the lower-rear frame in a desired position relative to the upper-rear frame; and (g) a top member interconnecting the top ends of the of the upper-front rails and the top ends of the upper-rear rails;

wherein:

(h) the upper-front frame, the lower-front frame, the upper-rear frame, and the lower-rear frame are substantially symmetrical about a common centerline;

(i) the lower-front frame may be selectively positioned relative to the upper-front frame by moving the front slide mechanisms within their corresponding front slide tracks;

(j) the lower-rear frame may be selectively positioned relative to the upper-rear frame by moving the rear slide mechanisms within their corresponding rear slide tracks;

(k) in all configurations of the stepladder, and as measured in any plane perpendicular to said centerline and intersecting both the upper-front frame and the lower-front frame, the upper-front frame is narrower than the lower-front frame; and (l) in all configurations of the stepladder, and as measured in any plane perpendicular to said centerline and intersecting both the upper-rear frame and the lower-rear frame, the upper-rear frame is narrower than the lower-rear frame.

2. The adjustable stepladder of claim 1 wherein the front slide member comprises a wheel and the rear slide member comprises a wheel.

3. The adjustable stepladder of claim 1 wherein the front slide member comprises a flat plate and the rear slide member comprises a flat plate.

4. The adjustable stepladder of claim 1 wherein the lower-front frame is disengageable from the upper-front frame and the lower-rear frame is disengageable from the upper-rear frame.

5. The adjustable stepladder of claim 1 wherein:

(a) the front locking means comprises a bracket rigidly connected to and projecting rearwardly from one of the upper-front rails, said bracket being disengageably lockable with a selected lower step; and (b) the rear locking means comprises a bracket rigidly connected to and projecting forwardly from one of the upper-rear rails, said bracket being disengageably lockable with a selected lower rail.

6. The adjustable stepladder of claim 1 wherein the front spring means comprises a helical spring and the rear spring means is a helical spring.

7. The adjustable stepladder of claim 1 wherein the upper-front frame is of constant width, the lower-front frame is of constant width, the upper-rear frame is of constant width, and the lower-rear frame is of constant width.

8. The adjustable stepladder of claim 1 wherein the upper-front frame is wider at the bottom than at the top, the lower-front frame is wider at the bottom than at the top, the upper-rear frame is wider at the bottom than at the top, and the lower-rear frame is wider at the bottom than at the top.

9. The adjustable stepladder of claim 1 wherein the upper-front rails may be detached from the top member, thereby allowing the assembly of the upper-front frame, the lower-front frame, and front locking means to be used as an extension ladder.

* * * * *